United States Patent [19]

Rowe, Jr. et al.

[11] 4,008,101

[45] Feb. 15, 1977

[54] METHYLENE CHLORIDE PHOSPHATIZING

[75] Inventors: Edward A. Rowe, Jr.; William H. Cawley, both of Lake County, Ohio

[73] Assignee: Diamond Shamrock Corporation, Cleveland, Ohio

[22] Filed: Mar. 20, 1975

[21] Appl. No.: 560,378

[52] U.S. Cl. ..... 148/6.15 R; 148/31.5

[51] Int. Cl.[2] ..... C23F 7/10

[58] Field of Search ..... 148/6.15 R, 6.15 Z, 148/31.5

[56] References Cited

UNITED STATES PATENTS

| | | | |
|---|---|---|---|
| 2,992,146 | 7/1961 | Low | 148/6.15 R |
| 3,100,728 | 8/1963 | Vullo et al. | 148/6.15 R |
| 3,197,345 | 7/1965 | Vullo et al. | 148/6.15 R |
| 3,306,785 | 2/1967 | Hitchcock | 148/6.15 Z |

FOREIGN PATENTS OR APPLICATIONS

| | | | |
|---|---|---|---|
| 1,222,351 | 8/1966 | Germany | 148/6.15 R |

*Primary Examiner*—Ralph S. Kendall
*Attorney, Agent, or Firm*—John J. Freer

[57] ABSTRACT

A liquid composition, containing methylene chloride, can provide phosphate coatings on metal articles. In addition to the methylene chloride, the composition contains a phosphatizing proportion of phosphoric acid and a solubilizing solvent capable of solubilizing phosphoric acid in methylene chloride. Most critically, the composition contains water in an amount exceeding the proportion of phosphoric acid, yet, the water-containing liquid composition maintains liquid phase homogeneity. Phosphatized coatings of desirable water insolubility are thereby obtained.

46 Claims, No Drawings

METHYLENE CHLORIDE PHOSPHATIZING

BACKGROUND OF THE INVENTION

Phosphatizing operations carried on in water have typically provided drawbacks, including sludging and the need for a multi-step operation, to achieve dry, coated articles. In an early attempt to overcome such problems, as described in U.S. Pat. No. 2,515,934, from 1 to 7% of the commercial phosphoric acid 85% syrup was used in an organic mixture, rather than in water. Representative of these mixtures was a 50/50 blend of acetone and carbon tetrachloride. With the blend, only a few steps were needed for phosphatizing.

A different approach to overcoming the problems that are found in water-based phosphatizing systems, was taken in the process of U.S. Pat. No. 2,992,146. Therein, by means of special equipment, an aqueous phosphatizing solution was sprayed onto a metal article, while the article was being maintained in a vapor degreasing zone. The vapor degreasing zone contained the vapors from a chlorinated hydrocarbon such as trichlorethylene. The operation thereby permitted enhanced drying of panels after phosphatizing.

In subsequently developed phosphatizing operations that relied on using chlorinated solvents, the water solution for the phosphatizing was altogether eliminated. In typical operations, a metal article for phosphatizing might be dipped in a chlorinated hydrocarbon degreasing solution, then come in contact with a non-aqueous phosphatizing solution, and thereafter be returned to the chlorinated hydrocarbon degreasing solution for a final rinse operation. Such operation has been described for example in U.S. Pat. Nos. 3,100,728 and 3,197,345. As also discussed in the U.S. Pat. No. 3,197,345, it was becoming recognized that there was a water-based process, also called an "aqueous" method of phosphatizing metal articles, and on the other hand a solvent-based process, which was therein noted as the "dry" process. The latter process typically employed a solution of phosphoric acid in a chlorinated hydrocarbon solvent. Since the compositions of the U.S. Pat. No. 3,197,345 relied on chlorinated hydrocarbons, the phosphatizing method used was the "dry" process and the useful compositions were substantially water-free compositions.

As early as in the U.S. Pat. No. 2,515,934, it was recognized that the commercial phosphoric acid would introduce a small amount of water into organic phosphatizing compositions. In the U.S. Pat. No. 3,197,345 teachings, it was regarded that substantially all of the water could be distilled from the phosphatizing bath as the dry treatment progressed. Getting away from a dependence on phosphoric acid was also explored. From this, it was found that special organic phosphate complexes could be useful in the non-aqueous solutions. They had the advantage of providing protective coatings of enhanced corrosion resistance. This approach was taken in U.S. Pat. No. 3,249,471. Another approach to the dry process, or to the "non-aqueous" process as it was also called, and that was employed in U.S. Pat. No. 3,297,495, was the use of a high strength acid. In such Patent, the acid used was preferably one of 96–100% phosphoric acid. This concentrated acid presented sludge problems, but these were overcome by employing special additives.

Other techniques, to maintain the non-aqueous phosphatizing process dry, included the use of drying agents such as magnesium sulfate and the use of powdered metals. These concepts have been discussed in U.S. Pat. No. 3,338,754. Therein it was emphasized that small amounts of water are detrimental to the phosphate coatings obtained from the non-aqueous phosphatizing solutions. It was also early recognized in the U.S. Pat. No. 2,515,934 that the presence of water in an organic phosphatizing system could lead to the formation of two liquid phases, with attendant problems developing. Phase separation, and especially with regard to the formation of a separate aqueous phase, was discussed in U.S. Pat. No. 3,306,785. It is also noted, from the U.S. Pat. No. 3,306,785, that in developing the dry process with chlorinated hydrocarbons, emphasis was being placed on the commercially important trichlorethylene and perchlorethylene solvents.

SUMMARY OF THE INVENTION

It has now been found that a chlorinated hydrocarbon phosphatizing composition can produce highly desirable coating when such composition is maintained in a more "wet" condition. An initial key ingredient for the composition is methylene chloride. A further critical ingredient, in addition to a phosphatizing proportion of phosphoric acid, is an amount of water exceeding such proportion of phosphoric acid. But such water is not present in sufficient amount to provide a liquid composition that does not retain liquid phase homogeneity. Moreover, it has now been found possible to increase the coating weight of the resulting phosphate coating, by increasing the water content of the phosphatizing composition well beyond a content of just minute amounts.

A further and most significant discovery, is the achievement of phosphatized coatings of extremely reduced water sensitivity. Because of this, phosphate coatings are now achieved wherein the coatings can be successfully topcoated with water based compositions. Such compositions can include aqueous chrome rinses. They can additionally include such coatings as water reduced paints and electrocoat primers. With the ingredients that are in the phosphatizing composition, including a solubilizing solvent capable of solubilizing the phosphoric acid in the methylene chloride, it has further been found that a vapor zone can be achieved in connection with the phosphating solution, in which zone there is obtained enhanced rinsing. For example, with the solubilizing solvent methanol, an especially desirable vapor zone can be obtained.

Liquid blends that can include methylene chloride, methanol and water as a portion of the blend have been known heretofore. Further, the methylene chloride/methanol and methylene chloride/water azeotropes have been recognized to have nearly adjacent boiling points. Such recognition has been given for example in U.S. Pat. No. 3,419,477. As in the U.S. Pat. No. 3,419,477, these phenomena have been previously recognized as useful in separation techniques. That is, separation of components can at least be initiated by making use of the azeotrope phenomena. Now, however, it has been found that in the vapor zone, created through the use of the phosphatizing compositions of the present invention, the vapor can provide for excellent rinsing of phosphate coated articles. Moreover, on condensation, the liquid condensed from the zone will retain complete liquid phase homogeneity without phase separation.

As a corollary, bath rejuvenation, for example, can be accomplished by introducing into the phosphatizing bath a uniform liquid. This liquid, in constituency, can be equated to the constituency of the vapor zone; it thus will be a homogenous blend. The blend is amenable to preparation for storage and/or handling, without loss of liquid phase homogeneity, prior to use as bath replenishing liquid.

Broadly, the invention is directed to a methylene-chloride and water-containing liquid composition having a continuous and homogenous liquid phase. The composition is suitable for phosphatizing metal with a water-resistent coating, while the liquid phase contains water in minor amount. More particularly, the composition comprises methylene chloride, solubilizing solvent capable of solubilizing phosphoric acid in methylene chloride, a phosphatizing proportion of phosphoric acid, and water in an amount exceeding the proportion of phosphoric acid while being sufficient for the composition to provide a phosphatized coating of substantial water insolubility, and while retaining liquid phase homogeneity.

Another aspect to the invention is the process of providing a phosphate coating, of the nature described herein above, by contacting a metal surface with a composition having a continuous and homogeneous liquid phase and containing water in a minor amount, with the composition further containing substances as described herein above. Such process may further include contacting of the metal surface, before the phosphatizing, with vapors containing methylene chloride, and may also include contacting, after the phosphatizing, of the coated metal surface with vapors containing methylene chloride.

Additional aspects of the invention include any of the foregoing phosphatizing processes followed by an aqueous chromium-containing solution treatment of the phosphatized metal surface. Other aspects of the invention include a vapor-containing rinse zone, for rinsing phosphate coated panels that have been in contact with the phosphatizing liquid, with such zone comprising a mixture of methylene chloride vapors, solubilizing solvent vapors and water vapor.

A still further aspect of the invention is a composition for sustaining phosphatizing from a phosphatizing liquid medium as above described. Such rejuvenating composition includes, in a homogeneous liquid blend, ingredients also found in the above-described, vapor-containing rinse zone.

DESCRIPTION OF THE PREFERRED EMBODIMENTS

The methylene chloride, or the "methylene chloride constituency" as it is sometimes referred to herein, is typically commercially available methylene chloride, and may contain additional ingredients, although the use of a more purified methylene chloride is contemplated. The methylene chloride may then contain very minor amounts of stabilizers such as cyclohexane. Useful, commercially available methylene chloride may contain very minor amounts of additional substances such as other chlorinated hydrocarbons, including chloroform and vinylidene chloride. It is further contemplated to use as the methylene chloride constituency, methylene chloride blended with a minor amount of additional solvent. This would be solvent in addition to the organic solvent discussed in greater detail hereinbelow. Preferably, the additional solvent will be non-flammable and will form an azeotrope with the methylene chloride on heating, e.g., trichloro trifluoroethane. Although the methylene chloride consituency will generally provide the major amount of the liquid phosphatizing solution and will typically provide between about 60 to about 90 weight percent of such solution, this is not always the case. Most always, when the methylene chloride constituency does not form the major amount of the solution, the solubilizing solvent will be the predominant substituent in the solution.

The solubilizing solvent needs to be one or a mixture that is capable of solubilizing phosphoric acid in methylene chloride. The solvent can also affect other characteristics of the phosphatizing solution, e.g., the solvent may have an effect on the solubility of water in the phosphatizing solution. It is advantageous that the solubilizing solvent not create a readily flammable phosphatizing liquid. It is preferable that it effect enhanced solubilization of water in the methylene chloride. It is further preferred, for efficient phosphatizing operation, that the solvent have a boiling point higher than the boiling point of methylene chloride, or that the solvent, on boiling, form an azeotrope with methylene chloride. The solvent can be, and on occasion most desirably is, a blend of organic substances. Such blends are particularly useful for augmenting the solubility of water in the phosphatizing solution.

Particularly where the phosphatizing solution will be used as a liquid phosphatizing bath, at elevated temperature, thereby forming a rinse zone immediately above the bath that contains constituents of the bath in vapor state, it is desirable that the solubilizing solvent be present in such vapor. When phosphatized metal articles are removed from the phosphatizing bath into such rinse zone, one ingredient that may be present on the article for rinsing is phosphoric acid. Since methylene chloride even as a vapor in the rinse zone will exert little solubilizing activity towards the phosphoric acid, it is desirable to have solvent vapor also present in the rinse zone.

Most advantageously for efficiency of operation the solubilizing solvent is an alcohol having less than six carbon atoms. Alcohols of six carbon atoms or more may be used, but should always be present in minor amount with at least one less than six carbon atoms alcohol being in major amount. Representative alcohols that can be or have been used include methanol, ethanol, isopropanol, n-pentanol, n-propanol, n-butanol, allyl alcohol, sec-butanol, tert-butanol and their mixtures wherein liquid phase homogeneity is maintained when in mixture with methylene chloride. However, additional substances, e.g., 2-butoxyethanol, can also be serviceable, alone or in combination with alcohol. As mentioned hereinabove, useful phosphatizing solutions can be achieved when the solvent provides the predominant constituent of the phosphatizing composition. Preferably for efficiency and economy the organic solvent is methanol.

As inferred hereinabove, phosphoric acid has only an extremely limited solubility in methylene chloride. However, this situation is obviated by using the solubilizing solvent. Therefore, although the phosphoric acid is a critical ingredient that is generally present in a very minor amount, with the solubilizing solvent present in the phosphatizing solution the phosphoric acid may be contained in the phosphatizing solution in substantial amount. Such amount might be up to 2–3 weight percent or more. But, for efficient and economical coating operation, the phosphoric acid is generally used in an amount below about one weight percent, basis total weight of the phosphatizing composition. A much greater amount than about 1%, will typically leave a coating on the metal substrate that is tacky to the touch. Preferably, for most efficient coating operation, the phosphoric acid is present in an amount between about 0.2–0.8 weight percent, basis the phosphatizing solution, although an amount below even 0.1 weight percent can be serviceable.

If it is contemplated that the phosphatizing solution will be used for the coating of metals that have been heretofore recognized as susceptible to phosphatizing, i.e., capable of reacting with phosphoric acid. Thus, it is contemplated that the phosphatizing solution will be useful for phosphatizing aluminum, zinc, cadmium and tin substrates as well as the more typical ferruginous metal substrates. The "phosphatizing proportion of phosphoric acid", as such term is used herein, may well be a "phosphatizing substance", as it might more appropriately be termed. That is, the use of such terms herein is not meant to exclude any substances that may be, or have been, useful in the solvent phosphatizing art for providing a phosphate coating. Such substances might thus include organic phosphate substance as well as the more typical acidic substances of phosphorous, e.g., the usual orthophosphoric acid. Further, it is contemplated that such substance include salts of such acids in phosphatizing. Since water is present in the phosphatizing solution in amounts greater than the phosphatizing substance, although concentrated acids are contemplated, e.g., phospholeum, the resulting solution contains the acid in dilution in water. Preferably, for economy, the orthosphosphoric acid is always the phosphoric substance used in the phosphatizing solution.

As mentioned hereinbefore, the amount of the phosphatizing substance in the phosphatizing solution is exceeded by the amount of water present in such solution. Water must be present in at least an amount sufficient to provide a phosphatized coating on ferrous metal of substantial water insolubility. As is discussed in greater detail hereinbelow, this means that the coating will be, at most, about 20% water soluble. On the other hand, water may typically be present in an amount as great as water saturation of the phosphatizing solution, at the temperature of phosphatizing. However, saturation is not exceeded as the solution will then lose liquid phase homogeniety. Homogeniety as used herein refers to solution uniformity free from liquid phase separation. When water separates, the separate water phase may attract phosphoric acid into such phase, to the detriment of further coating operation.

For many phosphatizing solutions of the present invention, on one hand water insoluble coatings are achieved, coupled with an acceptable coating weight, when the water content of the solution reaches about 1.5–2.5 weight percent. On the other hand, phase separation for many solutions can occur when the water content reaches about 5–7 weight percent, basis total solution weight. Such is shown in greater detail, by reference to the Examples. But, since the solubilizing solvent can affect the ability of a phosphatizing solution to solubilize water, then especially those solutions wherein the solubilizing solvent predominates, may be solutions able to contain substantial amounts of water, for example 10–25 weight percent of water might be reached without achieving saturation. But the water will always provide a minor weight amount of the phosphatizing solution.

Water in the solution will exert a vapor pressure; the solution water content will thereby directly influence the water content of the vapor zone associated with the solution. When such zone is over a bath of phosphatizing solution, a substantial amount of water vapor may retard the drying time of coated metal substrates that are phosphatized in the bath and then removed to the vapor zone for drying. Thus attention to the water content of a bath, when such might exceed about the 5–10 weight percent range is advisable. Since water is present in the phosphatizing solution in an amount in excess of phosphoric acid, it will most always be present in an amount within the range of about 2–5 weight percent.

Basic to the "phosphatizing solution" or "phosphatizing composition" as such terms are used herein, are the methylene chloride constituency, solubilizing solvent, phosphatizing proportion of phosphoric acid, and the water. A further substance that may be present in the phosphatizing solution is an aprotic organic substance. Although it is contemplated to use aprotic polar organic compounds for such substance, it is preferred for efficient coating operation to use dipolar aprotic organic compounds. These compounds act in the coating solution to retard the formation of an undesirable, grainy coating. The aprotic organic compound can also influence the level at which water saturation will occur in the phosphatizing compositions containing such compound, particularly when they are present in substantial amount. Although it is contemplated that such compound will always be present in minor weight amount of the phosphatizing solution, and generally present in an amount less than the amount of the solubilizing solvent, serviceable phosphatizing solutions can be prepared that contain on the order of 10 to 15 weight percent or more of such aprotic organic compound.

It is preferred, for extended retention of the aprotic organic compound in the phosphatizing solution during the phosphatizing operation, that such compound have a boiling point above the boiling point of the methylene chloride. Preferably, for most extended presence in the coating solution, such compound boils at least about 20° C higher than the methylene chloride. The aprotic organic compound is often a nitrogen-containing compound; these plus other useful compounds include N,N-dimethyl formamide, dimethyl sulfoxide, acetonitrile, acetone, nitromethane, nitrobenzene, tetramethylenesulfone and their inert and homogeneous liquid mixtures where such exist. By being inert, it is meant that such mixtures do not contain substituents that will chemically react with one another, in the phosphatizing solution, at the temperature attained for the solution to be at boiling condition. Dimethyl sulfoxide is useful as an aprotic organic compound; but, such may further be used as an accelerator compound, as is discussed herein below. In such case when the diemthyl sulfoxide is present as an accelerator compound, substance other than dimethyl sulfoxide is used to supply aprotic organic compound.

Another substance generally found in the phosphatizing composition is the organic accelerator compound. Such compound serves to increase the rate of formation of the coating during the phosphatizing process. Acceleration is accomplished without deleteriously affecting the nature of the coating, e.g., desirable uniform and non-grainy crystal structure for the coating. Serviceable compounds typically act in such manner even when present in the composition in very minor amount, as for example, in amount much less than one weight percent basis total composition weight. Advantageously, for efficient operation, the accelerator compound has a boiling point greater than the boiling point of methylene chloride. Many of the useful accelerator compounds are nitrogen-containing organic compounds. More specifically, compounds that can be, or have been, used include urea, pyridine, thiourea, dimethyl sulfoxide, dimethylisobutylene amine, ethylenediaminetetraacetic acid and dinitrotoluene.

The use of stabilizers has been taught in the prior art and such are contemplated for use herein, such as the hydrogen and hydrogen chloride acceptor substituents that can retard the corrosive nature of phosphatizing compositions. Stabilizers against oxidation of a halohydrocarbon, for example, are also known. These can likewise assist in reducing the corrosive nature of the phosphatizing composition. Useful substances can include p-benzoquinone, p-tertiaryamyl phenol, thymol, hydroquinone and hydroquinone monomethyl ether.

The methylene chloride containing phosphatizing composition is suitable for use with any of the phosphatizing operations that can be, or have been, used with solvent phosphatizing. Solvent phosphatizing operations can provide, quickly and efficiently, dry, coated metal substrates; and thus, such operations will most always provide for quickly achieving same. Sequentially, metal articles for phosphatizing may be typically degreased in methylene chloride degreasing solution and then immersed in a bath of the phosphatizing composition with such bath being most always heated to boiling condition. The phosphatized article, upon removal from the bath, can then be maintained in the vapor zone above the bath for evaporating volatile constituents from the coated article to coating dryness. During such maintenance, the article may be subjected to a spray rinse. The phosphatizing composition may also be spray applied to a metal article, such as in a vapor zone that might be formed and/or replenished by vapor from the spray composition. Other contemplated aspects of successful operation include initial rinsing of a metal article with warm rinse liquid, e.g., immersion rinsing in such liquid, wherein the liquid is formed from the constituents of the vapor from the phosphatizing solution. Such rinsing is then followed by phosphatizing, and this can be further followed by an additional rinse in the warm rinse liquid. For efficiency in all operations, the temperature of the phosphatizing composition is maintained at boiling condition. At normal atmospheric pressure this will typically be at a temperature within the range of about 100°–105° F. although lower temperatures of operation are contemplated. In the ambient atmosphere adjacent to the phosphatizing solution, constituents of such solution may be present in the vapor state. For convenience, this atmospheric region is thereby termed the "vapor zone".

During phosphatizing, which will take place typically in degreaser apparatus, the vapor zone, in addition to containing trace amounts of other substances, will be found to contain methylene chloride vapor, vapor from the solubilizing solvent that solubilizes the phosphoric acid in methylene chloride as well as water vapor. Since such substances are the chief ingredients of the vapor zone, they are the chief ingredients of the phosphatizing composition that can be expected to be lost from such composition as vapor loss. It has therefore been found to be most serviceable to formulate a replenishing liquid composition containing methylene chloride, solubilizing solvent and water. Further, it has been found that such replenishing liquid can be successfully used for sustaining the phosphatizing composition, and that such can form a homogeneous and storage-stable blend. Thus, for convenience, this liquid is often referred to herein as the "sustaining solution." The sustaining solution can be prepared ahead, for later use after storage and/or shipment. It can be useful for sustaining the formation of water-resistant and uniform coatings, especially when used for in-service phosphatizing solutions. The coatings from in-service solutions might be exhibiting loss of coating uniformity, for example.

In the make-up of the sustaining solution, the methylene chloride will be the predominant ingredient, generally supplying between 70–97 weight percent of the solution. In the balance, the solubilizing solvent will supply the major amount, being usually present in an amount between about 2–25 weight percent of the total solution. The water is present in minor amount, e.g. 0.5–2 percent or less, and always together with sufficient solubilizing solvent to insure solution homogeneity. For the preferred solvent methanol, the sustaining solution will preferably contain, for best sustaining action, between about 90–96 percent methylene chloride, about 2–9 percent methanol and 0.4–4 percent water, with the three components totalling 100 weight percent. Preferably, for enhanced phosphatizing operation, the water, solubilizing solvent and methylene chloride will be combined in the sustaining solution in the equivalent proportions of such substances in the phosphatizing medium vapor zone. To efficiently prepare a homogeneous sustaining solution, it is preferred to first preblend the water with solubilizing solvent. Then the methylene chloride is admixed with the preblend to quickly obtain a homogeneous sustaining solution. In the preferred method of preparation, and for the preferred solubilizing solvent methanol, the weight ratio of the water to the alcohol in the preblend is generally maintained at less than 1:6. Often, such ratio will be on the order of 1:10–1:12. Also in this preferred method of preparation, after the methylene chloride addition, additional ingredients, if present, are then generally added.

These additional ingredients will be present in very minor amounts. Typically these are present in combination in an amount less than about 1–2 weight percent based on the weight of the sustaining solution. Such ingredients can include accelerator compound, stabilizer compound, aprotic organic compound and phosphoric acid. However, where such sustaining composition is prepared for extended storage, the phosphoric acid is generally not included to avoid the use of special, acid-resistant containers. Preferably, for economy, the additional ingredients are each present in an amount less than about 0.1 weight percent.

For the preferred solvent methanol, in addition to the constituency of the sustaining solution being as described above, it is further advantageous for most efficient coating action that such solution be added to the phosphatizing medium so as to maintain the medium at a specific gravity between about 1.14 and about 1.17. At a specific gravity below about 1.14, commercially desirable coatings may not be efficiently achieved, while at a phosphatizing medium specific gravity greater than about 1.17, when the solubilizing solvent is methanol, coating formation can require undesirably delicate control. Preferably, for best phosphatizing from a methanol containing medium, the sustaining solution is used to maintain the medium specific gravity between about 1.15 and about 1.16.

As a pre-packaged blend, the sustaining solution in addition to being useful for sustaining, has further utility in the makeup of a fresh phosphatizing composition. When using the sustaining solution for fresh solution make-up, it has been found that typical additional ingredients for the solution make-up may also be prepared ahead in a storage-stable and uniform blend. This additional blend will generally contain, as chief ingredients, solubilizing solvent, aprotic organic compound and water. Further, such additional blend will often contain accelerator compound and stabilizer compound. Such blend is often referred to herein simply as the "precursor composition." As a precursor composition to the make-up of a fresh bath, substances are generally simply mixed together for preparing this precursor composition and then the composition is packaged for storage and/or handling. Most usually, the solubilizing solvent will comprise the major amount of this percursor composition, and preferably will supply between about 55–80 weight percent of the composition. Further, the water and aprotic organic compound may be present in substantially equivalent amounts. Each ingredient will generally be present in an amount between about 10–30 weight percent. Additional ingredients, e.g., accelerator compound or stabilizer compound, are each often present in an amount less than one weight percent, basis the weight of such precursor composition. In a typical fresh bath make-up, the precursor composition and the above described sustaining solution, with one or both of such generally containing accelerator plus stabilizer, are mixed together, often for use in degreasing apparatus, with phosphoric acid being added during the blending. Thus, only these two solutions plus phosphoric acid need be on hand at the inception of phosphatizing solution make-up.

After coating formation on a metal article, the article can then proceed into a vapor zone that will be supplied and replenished by vaporized substituents from the phosphatizing composition. As discussed herein before, such vapor zone can have a highly desirable make-up of methylene chloride vapor, water vapor and solubilizing solvent vapor as chief constituents. This vapor blend has been found to be highly suitable as a rinsing and drying medium for phosphatized articles. Typically, as in immersion phosphatizing, the coated article may be simply removed from the phosphatizing bath into the vapor zone, maintained in such zone until dry, and then removed for subsequent operation. The constituency of the vapor zone, in addition to supplying a desirable rinsing medium, will also form, on condensation, a stable, uniform liquid blend. This phenomenon enhances the simplicity of recirculation systems, as when coating operation is handled in degreaser apparatus. Also, such recirculation systems can be adapted to have the recirculating, condensed vapor replenished with fresh sustaining solution, which solution has been discussed hereinabove, with the replenished liquid then being recirculated to the phosphatizing solution medium.

As such medium in this operation will typically be maintained at a temperature at boiling condition, the temperature at the vapor zone will typically be within the range of about 100°–105° F. Further, the methylene chloride will form the predominant substance in the vapor zone. For example, in a phosphatizing composition wherein methanol is the solubilizing solvent, the vapor zone can be expected to contain above 90% by weight of methylene chloride, exclusive of the ambient air in such zone. But, because the vapor zone will also contain methanol vapor, as well as water vapor, such combination insures a highly desirable rinse vapor. More particularly, with the methanol as solvent, the vapor zone at normal pressure may be at a temperature from about 101° F. to about 104° F. and contain between about 0.6–0.7 weight part water, with between about 5.5–6.5 weight parts methanol and the balance methylene chloride to provide 100 weight parts.

The phosphatizing composition will typically provide a desirable phosphate coating, i.e., one having a weight of 20 milligrams per square foot or more on ferrous metal, in fast operation. Although contact times for ferrous metal articles and the phosphatizing composition may be as short as fifteen seconds for spray application, it will typically be on the order of about forty-five seconds to three minutes for dip coating, and may even be longer. The coating weights, in milligrams per square foot, can be on the order as low as ten to twenty to be acceptable, i.e., provide incipient corrosion protection with initial enhancement of topcoat adhesion, and generally on the order of as great as 100 to 150 although much greater weights, e.g., 300 or so, are contemplated. Preferably, for best coating characteristics including augmented topcoat adhesion and corrosion protection, the coating will be present in an amount between about 20–100 milligrams per square foot. Such coatings are readily and consistently produced with desirable coating uniformity.

The coatings that are obtained on ferrous metal will have at least substantial water insolubility, and hence are also termed herein to be "water-resistant" coatings. For determining water solubility, the test employed is sometimes referred to as the "water soak test". In this test, as is also described in connection with the examples, a coated ferruginous article is weighed and then immersed in distilled water for ten minutes. The water is maintained at room temperature, typically 65°–75° F, and with no agitation. After this ten minute immersion, the article is removed from the water, rinsed in acetone and air dried. Subsequently, on re-weighing, the amount of water solubility of the coating is shown by any weight loss. This loss is generally expressed as a percentage loss of the total original coating. The method used for determining the original coating weight has been more specifically described in connection with the examples.

Advantageously, for enhanced corrosion protection, the water solubility of the coating will be on the order of less than 20% as determined by the water soak test. Such a coating, for convenience, is often termed herein as a "phosphatized coating of substantial water insolubility". Preferably, for best coating performance, including the ability to receive topcoating with water-based topcoat compositions, the water solubility of the coating will be less than 5%, basis total weight of the original coating. In typical processing, the phosphatizing operation of the present invention will provide phosphatized coatings on ferruginous surfaces having virtually no water solubility as determined by the water soak test.

For better determining the nature of the coatings that are obtained on ferrous substrates, in addition to physical characteristics, they have been subjected to further coating analysis. As detailed more specifically in the examples, coatings from the phosphatizing operation that are of the iron phosphate type have been subjected to analysis by the Electron Spectroscopy for Chemical Analysis (ESCA) technique. Further, such coatings have been subjected to Auger Spectroscopy. For convenience, these may be referred to simply as "spectroscopic analysis". Such analysis confirms that the water insoluble coatings, that are obtained in the phosphatizing operation on a ferruginous substrate, contain in their make-up, the elements sodium and calcium in trace amounts. The balance of the elements is provided by phosphorous, iron, oxygen, carbon and nitrogen. Under similar analysis, comparative phosphatized coatings, which are water soluble coatings prepared from prior art phosphatizing techniques based on chlorinated hydrocarbon phosphatizing methods, fail to show such combination of elements in a phosphatized coating. Although all of the coatings are complex, because of the nature of the spectroscopic analysis techniques used in analyzing the coating, the make-up of the coating under analysis is expressed in the form of the elements. That is, it is to be understood that the coating is basically and completely defined by setting forth the elements. Although the elements will or may form various bonding relationships, the coating is defined by the elements is not limited to various particular relationships.

Because of the water resistant nature of the phosphate coating, the resulting coated metal substrates are especially adapted for further treatment with water based coating and treating systems. For example, the coated substrates may be further treated with acidified aqueous solutions typically containing a multivalent metal salt or acid in solution. Such treating solutions can contain hexavalent-chromium-containing substance, including the simplistic rinse solutions of chromic acid and water as mentioned in U.S. Pat. Nos. 3,116,178 or 2,882,189, as well as their equivalent solutions, for example the molybdic and vanadic acid solutions discussed in U.S. Pat. No. 3,351,504. Further these treating solutions may be non-aqueous, it being contemplated to use chromic acid solutions such as disclosed in U.S. Pat. No. 2,927,046. The treatment can include solutions containing additional, reactive ingredients, as for example the combination of chromic acid and formaldehyde disclosed in U.S. Pat. No. 3,063,877. Additional treatments that are contemplated include the complex chromic-chromates from solutions typically containing trivalent chromium, as has been discussed in U.S. Pat. No. 3,279,958. Further treatments that can be used include such as the blended complex chromate salts disclosed in U.S. Pat. No. 3,864,175 as well as solutions containing salts of other metals, as exemplified in U.S. Pat. No. 3,720,547, wherein salts of manganese are employed in treating solutions. All of these treatments will generally provide a coating having a weight of from about 2 to about 40 milligrams per square foot of treated substrate, although such weight may be lower, and is often greater, e.g., 100 milligrams per square foot or more. For convenience, these treatments and solutions collectively are sometimes referred to herein as "non-phosphatizing solutions for treating metal substrates".

The phosphatized coating also lends itself to topcoating from electrically deposited primers, such as the electrodeposition of film-forming materials in the well known electrocoating processes. Further, the phosphatized coatings can form the base coating for a water reducible topcoating. Such topcoating compositions typically contain solubilized polymers, similar to conventional alkyd, polyester, acrylic and epoxy types, that are typically solubilized with smaller amounts of organic amine. Also the resulting phosphate coated substrate can be further topcoated with any other suitable resin-containing paint or the like, i.e., a paint, primer, enamel, varnish or lacquer including a solvent reduced paint. Additional suitable paints can include the oil paints and the paint system may be applied as a mill finish.

Before applying the phosphate coating, it is advisable to remove foreign matter from the metal surface by cleaning and degreasing. Although degreasing may be accomplished with commercial alkaline cleaning agents which combine washing and mild abrasive treatments, the cleaning will generally include degreasing. Although such degreasing can be accomplished with typical degreasing systems, such degreasing can be readily and efficiently handled with methylene chloride degreasing solvent.

The following examples show ways in which the invention has been practiced but should not be construed as limiting the invention. In the examples all parts are parts by weight unless otherwise specifically stated. In the examples the following procedures have been employed.

Preparation of Test Panels

Bare steel test panels, typically 6 inches × 4 inches or 3 inches by 4 inches unless otherwise specified, and all being cold rolled, low carbon steel panels are typically prepared for phosphatizing the degreasing for 15 seconds in a commercial, methylene chloride degreasing solution maintained at about 104° F. Panels are removed from the solution permitted to dry in the vapor above the solution, and are thereafter ready for phosphatizing.

Phosphatizing of Test Panels and Coating Weight

In the examples, cleaned and degreased steel panels are phosphatized by typically immersing the panels into hot phosphatizing solution maintained at its boiling point, for from one to three minutes each. Panels removed from the solution pass through the vapor zone above the phosphatizing solution until liquid drains from the panel; dry panels are then removed from the vapor zone.

Unless otherwise specified in the examples, the phosphatized coating weight for selected panels, expressed as weight per unit of surface area, is determined by first weighing the coated panel and then stripping the coating by immersing the coated panel in an aqueous solution of 5% chromic acid which is heated to 160°–180° F. during immersion. After panel immersion in the chromic acid solution for 5 minutes, the stripped panel is removed, rinsed first with water, then acetone, and air dried. Upon reweighing, coating weight determinations are readily calculated. Coating weight data is presented in milligrams per square foot (mg/ft$^2$).

Mandrel Test Bending (ASTM-D 522)

The conical mandrel test is carried out by the procedure of ASTM D-522. Briefly, the testing method consists in deforming a paint-coated metal panel by fastening the panel tangentially to the surface of a conical steel mandrel and forcing the sheet to conform to the shape of the mandrel by means of a roller bearing, rotatable about the long axis of the cone and disposed at the angle of the conical surface, the angle of deformation or arc travel of the roller bearing being approximately 180°. Following the deformation, a strip of glass fiber tape coated with a pressure-sensitive adhesive is pressed against the painted surface on the deformed portion of the test panel and is then quickly removed. The coating is evaluated quantitatively according to the amount of paint removed by the adhesive on the tape, in comparison with the condition of a standard test panel.

Reverse Impact Strength

In the reverse impact test, a metal ram of specified weight, in pounds, with a hemispherical contact surface is allowed to drop from a predetermined height in inches onto the test panel. Paint removal is measured qualitatively or quantitatively on the convex (reverse) surface. In the qualitative measurement the impacted surface is merely observed by visual inspection and comparative panels, i.e., those subjected to the same impact in inch-pounds, are rated according to a numerical scale presented in Example 6 hereinbelow.

Cross-Hatch

This test is conducted by scribing, through the coating to the metal panel with a sharp knife, a first set of parallel lines one-eighth inch apart. A second, similar set of lines, is then scribed on the panel at right angles to the first set. Following this, a strip of glass fiber tape coated with a pressure-sensitive adhesive is pressed against the painted surface on the scribed portion of the test panel and is then quickly removed. The coating is rated in accordance with the numerical scale presented in Example 6 hereinbelow, based on the amount of paint removed by the adhesive on the tape.

Coin Adhesion

A fresh nickel coin is firmly secured in vise-grip pliers; the pliers are manually held in a position such that a portion of the rim of the nickel coin contacts the coated substrate at about a 45° angle. The nickel coin is then drawn down across the panel for about 2 inches. The type of coating flaking and/or chipping is evaluated qualitatively by visual observance, and panels are compared with the condition of a standard test panel.

EXAMPLE 1

To 288 parts of methylene chloride there is added, with vigorous agitation, 102.4 parts methanol, 1.3 parts ortho phosphoric acid, and 15.8 parts N,N-dimethyl formamide. These blended ingredients are thereafter boiled for 1 hour using a reflux condenser and the solution is permitted to cool. The water content of the resulting boiled solution, provided principally by the phosphoric acid, is found to be about 0.1 weight percent. This water content is directly determined by gas chromatograph analysis of a sample wherein the column packing is Porapak Q manufactured by Waters Associates, Inc. The resulting solution is then heated to 102°–103° F. and panels are phosphatized in the manner described hereinabove.

Some of the resulting coated panels, selected in sets of two with each panel in the set being coated under identical conditions, are then subjected to testing. One panel in the set is used for coating weight determination in the manner described hereinabove. The other panel in the set is subjected to the water solubility test. For this test the panel is weighed and then immersed in distilled water for ten minutes, the water being maintained at ambient temperature and with no agitation. Thereafter, the test panel is removed from the water, rinsed in acetone and air dried. Subsequently, on reweighing, the amount of water solubility of the coating is shown by the weight loss. This loss, basis total original coating weight, is reported in the Table below as the percentage or degree, of coating loss.

Coating weights and water solubility of coatings, are determined initially for test panels that have been phosphatized in the above-described phosphatizing composition. Such data are determined thereafter for additional coated panels that have been phosphatized in compositions of differing water contents, all as shown in the Table below. These baths of varying water content are prepared in step-wise fashion by starting with the above-described bath, and then adding about one weight percent water to the bath followed by boiling the resulting solution for 1 hour. This procedure is repeated with additional water increments of one weight percent, as shown in the Table below. The phosphatizing coating operation for each bath of varying water content has been described hereinabove. For each phosphatizing bath, water content determinations are made prior to phosphatizing by the above-described method.

TABLE I

| Coating Bath Water Content, Wt.% | Panel Coating Weight: mg/ft² | Degree of Solubility of Coating in Water |
|---|---|---|
| 0.1 | 4 | 60% |
| 1.1 | 6 | 50% |
| 2.1 | 10 | 20% |
| 3.1 | 13 | <5% |
| 4.1 | 24 | <5% |

The tabulated results demonstrate the enhancement in the degree of water insolubility for the phosphate coating as the water content in the phosphatizing bath increases. As determined by visual inspection, it is also noted that the degree of uniformity of the phosphate coating is increasing as the water content of the phosphatizing bath increases. For the particular system of this Example, the desirable water content is deemed to be between about 2 weight percent and about 5 weight percent. Below about 2 weight percent, the degree of water solubility for the coated panels is regarded as being excessive. By continuing the step-wise water addition discussed hereinabove, this system is found to separate free water, i.e., lose liquid phase homogeneity, when the water content reaches 5.1 weight percent.

EXAMPLE 2

A phosphatizing solution is prepared from 7510 parts of methylene chloride, 1731 parts methanol, 5 parts ortho phosphoric acid, 374 parts N,N-dimethyl formamide, and 7 parts dinitrotoluene. Prior to phosphatizing of steel panels the water content of the phosphatizing bath is determined, as described in Example 1, to be 373 parts.

Panels coated in the phosphatizing solution are subjected to the water solubility test. Such testing shows the panels to have a degree of solubility in water of below 5%. Coating weights for similar panels, but phosphatized for different coating times, are determined to be 35 mg/ft$^2$ for one panel (lower coating weight) and 60 mg/ft$^2$ for another panel (higher coating weight).

One of each panel of the lower and the higher coating weight is then selected for analysis by the Electron Spectroscopy for Chemical Analysis (ESCA) technique. This technique is used to evaluate the surface phenomena of the coated panels by providing a determination of the elements present. The instrument used is the HP 5950A, a spectrometer system with monochromatized X-radiation and manufactured by the Hewlett Packard Company. Under such evaluation, the surface of test panels is found to contain sodium and calcium in trace amounts and a balance of phosphorus iron, oxygen, carbon and nitrogen.

Such determination for the principal elements found in the phosphatized coating is further evaluated, using similar test panels, with Auger spectroscopy. For this analysis the instrument used is the PHI Model 540A thin film analyzer manufactured by Physical Electronics Industries, Inc. Such analysis confirms the presence at the surface of the test panels of the elements phosphorous, iron, oxygen, carbon and nitrogen.

EXAMPLE 3

To 380.2 parts of methylene chloride there is added, with vigorous agitation, 81 parts methanol, 2.3 parts ortho phosphoric acid, 14.9 parts N,N-dimethyl formamide and 0.4 part dinitrotoluene. These blended ingredients are thereafter processed in the manner of Example 1 to prepare a phosphatizing solution having a water content of about 0.1 weight percent.

Degreased steel panels are then phosphatized in the composition. Additional phosphatizing compositions but having differing water contents, as shown in the Table below, are prepared as described in Example 1. Phosphatizing operation for each bath of varying water content is also as has been described hereinbefore. As shown in the Table below, for each phosphatizing bath, water content determinations are made prior to phosphatizing and coating weights and water solubility testing for coatings, are determined for all phosphatized panels.

TABLE II

| Coating Bath Water Content, Wt.% | Panel Coating Weight; mg/ft$^2$ | Degree of Solubility of Coating in Water |
|---|---|---|
| 0.1 | 9 | 17% |
| 0.8 | 9 | 8% |
| 2.1 | 14 | <5% |
| 3.0 | 22 | <5% |
| 4.2 | 31 | <5% |

The tabulated results demonstrate the enhancement in the degree of water insolubility of the phosphate coating as the water content in the phosphatizing bath increases; also, visual inspection confirms that the degree of uniformity of the phosphate coating is increasing as the water content of the phosphatizing bath increases. Also the coating weight shows a dramatic increase along with the increase in water content of the coating bath at a water content level above 2 weight percent. For the particular system of this Example, the desirable water content is deemed to be between about 2 weight percent and about 5 weight percent. Below about 2 weight percent, a desirable coating is not efficiently achieved. Coating weight is very small. By further water addition to the bath, this system is found to separate free water, i.e., lose liquid phase homogeneity, when the water content reaches 5.1 weight percent.

EXAMPLE 4

A standard solution was prepared to contain, by weight, 1188 parts of methylene chloride, 253 parts methanol, 7.3 parts ortho phosphoric acid, 60 parts water and 1.0 part dinitrotoluene. These ingredients were blended together with vigorous agitation and thereafter aliquot portions of this solution were taken. These aliquots each contained 118.8 parts of methylene chloride with additional ingredients thus scaled down respectively. To each aliquot there was then added an aprotic organic compound.

The aprotic organic substance for each aliquot, together with its proportion in each aliquot, are shown in the Table below. Baths for phosphatizing were prepared from each aliquot, steel panels were phosphatized and the phosphatizing operation was carried on all as has been described hereinbefore. For each aliquot the water content is shown in the Table below; it was determined as the proportion of the water for each aliquot derived from the standard solution. Coating weights were determined by visual observation, noting panel color; from experience with such technique of noting panel coating weight change with color change, the figures in the Table have been given, as typical, a constant degree of accuracy of ±5 mg/ft$^2$.

TABLE III

| Aprotic Organic Substance | | Coating Bath Water | Panel Coating |
|---|---|---|---|
| Substance | Amt. Wt.% | Content,Wt.% | Wt. mg/ft$^2$ |
| Dimethyl Sulfoxide | 3.5 | 3.83 | 35 |
| Acetonitrile | 2.5 | 3.87 | 80 |
| Acetone | 2.6 | 3.87 | 25 |
| Nitromethane | 3.6 | 3.83 | 60 |
| Nitrobenzene | 3.8 | 3.82 | 55 |
| Tetramethylene Sulfone | 4.2 | 3.82 | 35 |

In all cases, desirable uniform phosphate coatings were noted by visual inspection of coated panels.

EXAMPLE 5

Solutions in the nature of the aliquots of Example 4 were prepared to contain, by weight, 118.8 parts of methylene chloride, 4.7 parts N,N-dimethyl formamide, 0.73 part ortho phosphoric acid and 0.1 part dinitrotoluene. During the blending of each solution there was added water plus a solubilizing solvent.

The solvent for each solution, together with its proportion in each solution, are shown in the Table below. The proportion of water in each solution is also shown in the Table below. Baths for phosphatizing were prepared from each solution in the manner discussed hereinabove. Steel panels, these panels being 2 inches × 4 inches cold rolled, low carbon steel panels, were then phosphatized. For each panel the coating weight was determined, as described in Example 4, and data for this is shown in the Table below.

TABLE IV

| Organic Solvent Substance | Amt. Wt.% | Coating Bath Water Content, Wt.% | Panel Coating Wt.mg/ft² |
|---|---|---|---|
| Ethanol | 17.9 | 3.77 | 45 |
| n-Propanol | 26.4 | 3.38 | 50 |
| iso-Propanol | 23.4 | 3.50 | 40 |
| Allyl Alcohol | 34.4 | 3.02 | 45 |
| n-Butanol | 41.7 | 2.68 | 40 |
| sec-Butanol | 38.5 | 2.83 | 55 |
| tert-Butanol | 33.9 | 3.04 | 25 |
| n-Pentanol | 49.9 | 2.30 | 35 |

In all cases, desirable uniform phosphate coatings were noted by visual inspection of coated panels, including the bath containing the n-pentanol, in which bath the methylene chloride does not provide the major amount of the bath composition.

EXAMPLE 6

In the manner described hereinabove, a phosphatizing solution is prepared to contain, by weight, the following ingredients: 60 parts water, 1188 parts methylene chloride, 253 parts methanol, 7.3 parts ortho phosphoric acid, 47.2 parts N,N-dimethyl formamide and 1.0 part dinitrotoluene. Hereinafter, for convenience, the resulting phosphatizing solution is referred to as the "new organic phosphatizing composition".

Steel panels were phosphatized in this new organic phosphatizing composition. Further, in the manner described hereinbefore, but for comparative purposes, panels were phosphatized in a well-known and extensively-used commercial phosphatizing bath based on trichloroethylene. Hereinafter for convenience, this bath is referred to as the "standard organic phosphatizing composition". This standard organic phosphatizing composition was prepared by blending together ortho phosphoric acid, with two products sold under the tradenames of "Triclene-L" and "Triclene-R", to contain a commercially acceptable amount of phosphoric acid in the blend. The use of such a commercial phosphatizing bath has been described, for example, in U.S. Pat. No. 3,356,540.

Additional comparative test panels used herein for evaluation are panels phosphatized with an aqueous phosphatizing composition and prepared in accordance with specifications that are generally accepted as standards for performance in the automotive and household appliance industries. These comparative test panels, for convenience, are generally referred to herein as prepared from the "comparative aqueous phosphatizing composition". Such composition is a solution that can contain zinc acid phosphate, with the test panels being dipped in this aqueous solution typically for 1 minute. Thereafter, the test panels are rinsed and then immersed in a dilute solution of chromic acid. Such test panels are then dried and are thus provided with a chromic acid rinse coating.

All test panels are painted, before testing, with a commercial enamel topcoat. The enamel is a commercial white alkyd baking enamel; the enamel ostensibly contains a modified alkyd resin based upon a system of partially polymerized phthalic acid and glycerin, and has 50 weight percent solids. After coating panels with the enamel, the coating is cured on all panels by baking in a convection oven for 20 minutes at a temperature of 320°–325° F.

Panels are then selected and subjected to the various tests described hereinbefore for testing paint film retention and integrity. The tests used, and the results obtained, are listed in the Table below. In the conical mandrel test, the numbers listed in the Table are centimeters of paint removal after taping; the reverse impact test is conducted at 64 inch-pounds. For the reverse impact test and the conical mandrel test, where a range is presented in the Table, such range results from the testing of a series of panels.

In the following Table the efficacy of the total coating obtained on the coated parts in the cross hatch and reverse impact tests is quantatively evaluated on a numerical scale from 0 to 10. The parts are visually inspected and compared with one another and the system is used for convenience in the reviewing of results. In the rating system the following numbers are used to cover the following results:

10 complete retention of film, exceptionally good for the test used;
8 some initial coating degradation;
6 moderate loss of film integrity;
4 significant film loss, unacceptable degradation of film integrity;
2 some coating retention only;
0 complete film loss.

TABLE V

| Phosphatizing Composition | Cross Hatch | Conical Mandrel | Reverse Impact | Coin Adhesion |
|---|---|---|---|---|
| New Organic Phosphatizing Composition | 10 | 0–1.7 | 6–9 | Good |
| Standard Organic Phosphatizing Composition | 10 | 0.4–1.9 | 4–8 | Good |
| Comparative Aqueous Phosphatizing Composition | 10 | 1.9 | 4–9 | Good |

The above-tabulated results show that the phosphate coating from the new organic phosphatizing composition can provide paint adhesion that will compare under a variety of tests as the equal of or superior to, comparative systems based either on organic commercial baths or aqueous compositions.

In further and related testing, panels from the new organic phosphatizing composition are provided with a chrome rinse from a dilute chromic acid solution. This is done to equate the nature of the coating on the panels with that from the aqueous phosphatizing composition. All test panels are topcoated with an alkyd enamel paint system and then panels are subjected to a variety of tests. Comparable results, for each specific test, are obtained among all tested panels. Such equality of test results is achieved even when testing of comparative panels in the standard salt spray (fog) test, ASTM B-117-64.

EXAMPLE 7

To 356.4 parts of methylene chloride there is added, with vigorous agitation, 106.6 parts ethanol, 2.4 parts ortho phosphoric acid and 15.3 parts N,N-dimethylformamide. These blended ingredients are thereafter processed in the manner of Example 1 to prepare a phosphatizing solution having a water content of about 0.1 weight percent.

Degreased steel panels are then phosphatized in the composition. Additional phosphatizing compositions, but having differing water contents, as shown in the Table below, are prepared as described in Example 1. Phosphatizing operation for each bath of varying water content is also as has been described hereinbefore. As shown in the Table below, for each phosphatizing bath, coating weights and water solubility testing for coatings, are determined for phosphatized panels.

TABLE VI

| Coating Bath Water Content, Wt.% | Panel Coating Weight; mg/ft² | Degree of Solubility of Coating in Water |
|---|---|---|
| 0.1 | 14 | 28% |
| 1.1 | 10 | 30% |
| 2.1 | 22 | 7% |
| 3.1 | 27 | <5% |
| 4.1 | 125 | <5% |

The tabulated results demonstrate the enhancement in the degree of water insolubility of the phosphate coating as the water content in the phosphatizing bath increases; also, visual inspection confirms that the degree of uniformity of the phosphate coating is increasing as the water content of the phosphatizing bath increases. Also, after an initial reversal, the coating weight increases right along with the increase in water content of the coating bath. For the particular system of this Example, the desirable water content is deemed to be greater than 2.1 weight percent and up to about 5 weight percent. By further water addition to the bath, this system is found to separate free water, i.e., lose liquid phase homogeneity, when the water content reaches 5.1 weight percent.

For comparative purposes, the standard organic phosphatizing composition described in Example 6 is used to coat panels and the panels are tested. This composition, based on trichlorethylene, has met with commercial acceptance as a solvent phosphatizing composition. When the composition contains 0.2 weight percent water, all water determinations being by the method described in Example 1, the composition provides for a very uniform coating of desirable weight. All panel coating is conducted as has been described hereinbefore.

The 0.2 weight percent water content, although not typical for such a commercial bath, can be presented and contributed by the other substituents in the bath, as for example, when the acid is provided in the orthophosphoric form. A test panel from this bath, in water solubility testing, exhibits a degree of water solubility of 60%. A duplicate bath, except that it is in equilibrium with 0.5 weight percent water, supplied by water addition, also yields uniform coatings of desirable weight.

At the 0.5 weight percent level, the coating has a degree of water solubility of 28%. This approaches the minimum degree for coatings from such bath, since upon further water addition, the bath is found to lose homogeneity at only 0.6 weight percent water.

EXAMPLE 8

A standard solution was prepared to contain, by volume, 900 parts of methylene chloride, 320 parts methanol, 50 parts N,N-dimethylformamide, 4.5 parts ortho phosphoric acid and 60 parts water. These ingredients were blended together with vigorous agitation and thereafter aliquot portions of this solution were taken. These aliquots each contained 90 parts of methylene chloride with additional ingredients thus scaled down respectively. To each aliquot there was then added 0.064 weight percent of organic accelerator compound, with the exception of one aliquot that was kept free from accelerator compound for comparative purposes.

The particular organic accelerator substance for each aliquot is shown in the Table below. Baths for phosphatizing were prepared from each aliquot, steel panels were phosphatized and the phosphatizing operation was carried on all as has been described hereinbefore, with all panels being coated for an equal time. Coating weights were determined as described hereinbefore and are shown in the Table below. Relative coating weights for coatings from each aliquot, basis a given weight of 1.00 for the coating weight from the aliquot that was maintained free from accelerator compound, are also shown in the Table.

TABLE VII

| Organic Accelerator Substance | Panel Coating Wt.mg/ft² | Relative Panel Coating Weight |
|---|---|---|
| None | 45 | 1.00 |
| Ethylenediaminetetraacetic acid* | 48 | 1.07 |
| Dinitrotoluene | 55 | 1.22 |
| Dimethyl Isobutylene Amine | 56 | 1.24 |
| Dimethyl Sulfoxide | 62 | 1.38 |
| Thiourea | 63 | 1.40 |
| Pyridine | 71 | 1.58 |
| Urea | 78 | 1.73 |

*Disodium salt.

In all cases, desirable phosphate coatings were noted.

EXAMPLE 9

A phosphatizing bath is prepared in the manner of Example 1 to contain, on a basis of 100 parts of prepared bath: 46.47 parts methylene chloride, 48.96 parts 2-butoxyethanol, 2.34 parts water, 1.84 part N,N-dimethylformamide, 0.35 part phosphoric acid and 0.04 part dinitrototuene. Steel test panels are then phosphatized and are thereafter subjected to visual inspection for interpretation of coating results. By such inspection the phosphatized panels are viewed to have a desirably uniform coating of sufficient weight deemed to be acceptable for commercial purposes. This result is achieved with the 2-butoxyethanol being present as the organic solvent and with the methylene chloride not being present in major amount.

EXAMPLE 10

A composition for sustaining phosphatizing by addition to a depleted phosphatizing bath is prepared by blending together 93.28 parts methylene chloride, 5.99 parts methanol, 0.71 part water, 0.01 part p-tertiaryamyl phenol and 0.01 part p-benzoquinone. Hereinafter, the resulting homogeneous, stable solution is referred to as the "bath-sustaining solution".

There is separately prepared, by blending together into a homogeneous solution, 62.75 parts methanol, 17.57 parts water, 19.13 parts N,N-dimethylformamide, 0.38 part dinitrotoluene, 0.12 part p-tertiaryamyl phenol, and 0.044 part p-benzoquinone. One part by volume of this resulting uniform solution is then blended with three parts by volume of the bath-sustaining solution. To this resulting homogeneous blend there is then added sufficient orthophosphoric acid to provide about 0.22%, by volume, of the orthophosphoric acid in the resulting blend.

The phosphatizing bath thereby prepared is subsequently used to phosphatize degreased 3 inch × 4 inch steel panels. These phosphatized panels are referred to hereinafter as the "initially-phosphatized panels". Following this initial working of the bath, the bath is subjected to heat-induced vapor loss. From the working and the subsequent vapor loss, the bath experiences about a 31% loss, by volume. This is deemed to be a loss that would otherwise be observed following very frequent, extended use of the bath as a phosphatizing bath.

After this contraction in the bath, additional panels, being degreased 3 inch × 3 inch steel panels for reconciliation with the volume of the bath, are coated. These coated panels are referred to hereinafter as the "depleted bath panels".

The resulting depleted bath is then permitted to cool, and the cool bath is restored to its original volume by adding the bath-sustaining solution. After addition, the bath is then heated, as described in Example 1, and additional 3 inch × 4 inch steel panels are coated. Resulting coated panels are referred to as the "restored bath panels".

The quality of the coating on the panels, from both the new bath panels and the restored bath panels, is deemed to be of a quality acceptable for commercial purposes. Such quality is judged by visual inspection of coating uniformity as well as determination of coating weight, which determination is conducted as has been described hereinbefore. On the other hand, the depleted bath panels can be seen from visual inspection to have non-uniform coatings that are judged to be commercially unacceptable. Thus, the worked bath of contracted volume that provides commercially unacceptable panels, can be successfully rejuvenated with the bath-sustaining solution, as is evidenced by coatings achieved on resulting coated panels.

EXAMPLE 11

To 82.5 parts of methylene chloride there is added, with vigorous agitation, 17.0 parts methanol and 0.5 part ortho phosphoric acid. The resulting phosphatizing solution has a water content of about 0.1 weight percent, at least principally contributed by the acid. A degreased steel panel is then phosphatized in the composition. Additional phosphatizing compositions, but having differing water contents, are prepared as described in Example 1, and panels are phosphatized in such compositions. All phosphatizing operations are as have been described hereinbefore. Coating weights and water solubility testing for coatings, are determined for selected phosphatized panels. As the bath water content goes from 3 to 4%, the coating weight goes from 20 to 97 mg/ft$^2$ respectively. However, with a bath at the 3.2 percent water level, the most desirable coating, at a weight of about 35 mg/ft$^2$ and having less than 5% water solubility, is achieved. This result is obtained although the bath contains no aprotic polar organic compound.

We claim:

1. A methylene chloride and water-containing liquid composition having a continuous and homogeneous liquid phase suitable for phosphatizing metal with a coating of at least substantial water insolubility, with said liquid phase containing water in minor amount, which composition comprises methylene chloride, solubilizing solvent capable of solubilizing phosphoric acid in methylene chloride, a phosphatizing proportion of phosphoric acid, and water in an amount exceeding said proportion of phosphoric acid, while being sufficient for said composition to provide a phosphatized coating of substantial water insolubility, and while retaining liquid phase homogeneity.

2. The composition of claim 1 wherein the methylene chloride supplies the major amount of said composition.

3. The composition of claim 1 wherein the solubilizing solvent is an alcohol having less than 6 carbon atoms.

4. The composition of claim 1 wherein the solubilizing solvent is selected from the group consisting of methanol, ethanol, isopropanol, n-pentanol, 2-butoxyethanol, n-propanol, n-butanol, allyl alcohol, sec-butanol, tert-butanol and their mixtures.

5. The composition of claim 1 characterized by containing methylene chloride, methanol, phosphoric acid and water.

6. A methylene chloride and water-containing liquid composition having a continuous and homogeneous liquid phase, said composition being suitable for phosphatizing metal with a coating of at least substantial water insolubility and enhanced uniformity, with said liquid phase containing water in minor amount, which composition comprises methylene chloride, aprotic polar organic compound, solubilizing solvent capable of solubilizing phosphoric acid in methylene chloride, a phosphatizing proportion of phosphoric acid, and an amount of water, exceeding said proportion of phosphoric acid while being sufficient for said composition to provide a phosphatized coating of substantial water insolubility and while retaining liquid phase homogeneity.

7. The composition of claim 6 wherein the aprotic organic compound supplies a minor amount of said composition.

8. The composition of claim 6 further characterized by containing methylene chloride in major amount.

9. The composition of claim 6 wherein the aprotic organic compound is selected from the group consisting of N,N-dimethylformamide, dimethyl sulfoxide, acetonitrile, acetone, nitromethane, nitrobenzene, tetramethylenesulfone and their inert and homogeneous liquid mixtures where such exist.

10. The composition of claim 6 characterized by containing methylene chloride, methanol, N,N-dimethylformamide, phosphoric acid and water.

11. The composition of claim 10 characterized by containing water in an amount above 2 weight percent, basis total composition weight.

12. A methylene chloride and water-containing liquid composition having a continuous, homogeneous liquid phase suitable for phosphatizing metal with a coating of at least substantial water insolubility and of accelerated formation with enhanced uniformity, with said liquid phase containing water in minor amount, which composition comprises methylene chloride, solubilizing solvent capable of solubilizing phosphoric acid in methylene chloride, a phosphatizing proportion of phosphoric acid, aprotic polar organic compound, organic accelerator compound, and water in an amount exceeding said proportion of phosphoric acid, while being sufficient for said composition to provide a phosphate coating of substantial water insolubility, and while retaining liquid phase homogeneity.

13. The composition of claim 12 wherein said accelerator compound is a nitrogen-containing organic compound having a boiling point greater than the boiling point of methylene chloride.

14. The composition of claim 12 wherein said accelerator compound is selected from the group consisting of urea, pyridine, thiourea, dimethyl sulfoxide, dimethyl isobutylene amine, nitrated aromatic compounds containing the nitro group, ethylenediaminetetraacetic acid and mixtures thereof, with the proviso that when dimethyl sulfoxide is said accelerator compound, substance other than dimethyl sulfoxide supplies said aprotic polar organic compound.

15. The composition of claim 12 characterized by containing methylene chloride, methanol, N,N-dimethylformamide, phosphoric acid, dinitrotoluene and water.

16. The composition of claim 15 further characterized by containing above about 60 weight percent methylene chloride and below about 2 weight percent phosphoric acid.

17. The process of providing a phosphate coating of at least substantial water insolubility on the surface of a metal of the class capable of reacting with phosphoric acid, which process comprises contacting said surface with a composition having a continuous and homogeneous liquid phase and containing water in minor amount, with said composition containing methylene chloride, solubilizing solvent capable of solubilizing phosphoric acid in methylene chloride, a phosphatizing proportion of phosphoric acid, and water in an amount exceeding said proportion of phosphoric acid while being sufficient for said composition to provide a phosphate coating of substantial water insolubility, and while retaining liquid phase homogeneity.

18. The method of forming an adherent and at least substantially water-insoluble phosphate coating on the surface of a metal substrate, which method comprises:

A. bringing into contact said surface with vapors containing methylene chloride, thereby preparing a vapor-treated metal surface;

B. contacting the resulting vapor-treated surface with a liquid phosphatizing composition containing water in minor amount, with said composition further containing methylene chloride, solubilizing solvent capable of solubilizing phosphoric acid in methylene chloride, a phosphatizing proportion of phosphoric acid, and with said water being present in an amount exceeding said proportion of phosphoric acid while being sufficient for said composition to provide a phosphate coating of substantial water insolubility, and while retaining liquid phase homogeneity; and C. withdrawing said surface from contact with said composition and evaporating volatile constituents from the resulting coated surface.

19. The method of claim 18 characterized by immersing said vapor-treated surface in said phosphatizing composition.

20. The method of claim 18 characterized by spraying said vapor-treated surface with said phosphatizing composition.

21. The method of claim 18 further characterized by withdrawing the coated surface from said phosphatizing composition and passing same in to a vapor zone containing methylene chloride vapors, while permitting evaporation of said volatile constituents from the coated surface in said vapor zone.

22. The method of preparing a coated metal substrate having on the surface thereof an adherent, corrosion-resistant and water-insoluble coating, which method comprises:

A. contacting the metal surface with a liquid composition having a continuous and homogeneous liquid phase containing water in minor amount, with said composition containing methylene chloride, solubilizing solvent capable of solubilizing phosphoric acid in methylene chloride, a phosphatizing proportion of phosphoric acid, and water in an amount exceeding said proportion of phosphoric acid while being sufficient for said composition to provide a phosphate coating of substantial water insolubility on said surface, and while retaining said liquid phase homogeneity; and, B. contacting the resulting phosphatized metal surface with a non-phosphatizing solution for treating metal surfaces.

23. A composition for sustaining phosphatizing from a methylene chloride and water-containing liquid phosphatizing medium having a homogeneous liquid phase containing water in minor amount, which medium can provide a uniform coating of at least substantial water insolubility on the surface of a metal of the class capable of reacting with phosphoric acid, and said composition sustains the formation of said water-insoluble and uniform coating, which composition is a homogeneous blend containing, as constituents that are each present in the composition in an amount substantially above about 0.1 weight percent, basis weight of the composition, methylene chloride, solubilizing solvent capable of solubilizing phosphoric acid in methylene chloride and water.

24. The composition of claim 23 wherein the solubilizing solvent is an alcohol having less than 6 carbon atoms.

25. The composition of claim 23 wherein said methylene chloride is present in major amount, and the amount of solubilizing solvent exceeds the amount of water in said composition.

26. The composition of claim 23 wherein the proposition of said constituents in the sustaining solution is equivalent to such proportion of said constituents in the phosphatizing medium vapor zone.

27. The composition of claim 25 further characterized by containing an accelerator compound for said phosphatizing medium.

28. The composition of claim 27 characterized by containing methylene chloride, methanol, water and dinitrotoluene.

29. The composition of claim 24 further characterized by containing stabilizer compound for said phosphatizing medium.

30. The composition of claim 29 further characterized by containing methylene chloride, methanol, water and a substance selected from the group consisting of p-benzoquinone, p-tertiaryamyl phenol and mixtures thereof.

31. The method of preparing a composition for sustaining phosphatizing from a methylene chloride and water-containing liquid phosphatizing medium having a homogeneous liquid phase containing water in minor amount, wherein said composition is a homogeneous sustaining blend containing methylene chloride, solubilizing solvent and water, which method comprises blending said solubilizing solvent with water to provide a blended solution and thereafter admixing methylene chloride to said blended solution for preparing said homogeneous sustaining blend.

32. The method of claim 31 further characterized by blending said solubilizing solvent and water together in a proportion equivalent to the proportion of said constituents in the vapor zone from said phosphatizing medium.

33. The method of claim 32 further characterized by admixing methylene chloride with said blend in a proportion equivalent to the proportion of methylene chloride in the vapor zone of said phosphatizing medium.

34. The method of claim 31 characterized by blending methanol and water to provide a blended solution having a weight ratio of water to methanol of less than 1:6.

35. The method for sustaining phosphatizing from a methylene chloride and water-containing liquid phosphatizing medium having a homogeneous liquid phase containing water in minor amount, wherein the phosphatizing from said medium will provide a uniform coating of at least substantial water insolubility on the surface of a metal of the class capable of reacting with phosphoric acid, and wherein said method sustains the formation of said water insoluble, uniform coating, which method comprises:

A. mixing substituents comprising methylene chloride, solubilizing solvent capable of solubilizing phosphoric acid in methylene chloride and water in to a homogeneous liquid blend; and B. admixing said blend in to said liquid phosphatizing medium, thereby preparing a sustained medium for phosphatizing.

36. The method of claim 35 further characterized by bringing in to contact with said sustained medium the surface of a metal of the class capable of reacting with phosphoric acid.

37. The method of claim 35 further characterized by the adding, along with said admixing, of phosphoric acid to said liquid phosphatizing medium, thereby preparing said sustained medium having an enhanced phosphatizing proportion of phosphoric acid.

38. The method of claim 35 further characterized by mixing methylene chloride, methanol, water and organic accelerator compound in to said homogeneous liquid blend.

39. The method of claim 35 further characterized by mixing substituents comprising methylene chloride, methanol and water in to said homogeneous liquid blend and admixing said blend in to a methanol-containing liquid phosphatizing medium in an amount sufficient to maintain the specific gravity of said medium between about 1.14 at about 1.17.

40. The method of rinsing and drying a phosphate-coated metal that has been in contact with a phosphatizing liquid composition, which method comprises exposing said coated metal to a vapor zone containing in the ambient atmosphere of said zone a mixture of methylene chloride vapor, solubilizing solvent vapor and water vapor, said vapor zone being maintained at a temperature within the range of from about 100° F. to about 105° F. at normal pressure, and wherein said vapor mixture will provide, on condensation, a homogeneous liquid condensate, and permitting evaporation of volatile constituents from said coated metal while exposed to said vapor zone.

41. The method of claim 40 characterized by contacting said coated metal with liquid rinse composition containing condensate from said vapor zone, then exposing the resulting contacted metal to said vapor zone.

42. A storage-stable liquid precursor composition, useful in preparing a methylene-chloride-containing liquid phosphatizing medium having a homogeneous liquid phase containing water in minor amount, wherein said phosphatizing medium can provide a uniform coating of at least substantial water insolubility on the surface of a metal of the class capable of reacting with phosphoric acid, which composition is a homogeneous blend containing, as constituents that are each present in the composition in an amount substantially above about 0.2 weight percent, basis weight of the composition, solubilizing solvent capable of solubilizing phosphoric acid in methylene chloride, aprotic polar organic compound, organic accelerator compound for said phosphatizing medium and water.

43. The composition of claim 42 further characterized by containing phosphoric acid.

44. The composition of claim 42 further characterized by containing stabilizer compound for said phosphatizing medium.

45. The composition of claim 42 characterized by containing methanol, N,N-dimethylformamide, water and dinitrotoluene.

46. The composition of claim 42 characterized by containing said solubilizing solvent in major amount and said organic accelerator compound in amount below about one percent, basis weight of said composition.

* * * * *